US007217172B2

(12) United States Patent
Benner

(10) Patent No.: US 7,217,172 B2
(45) Date of Patent: May 15, 2007

(54) ENHANCED END EFFECTOR ARM ARRANGEMENT FOR CMP PAD CONDITIONING

(75) Inventor: Stephen J. Benner, Lansdale, PA (US)

(73) Assignee: TBW Industries Inc., Furlong, PA (US)

( * ) Notice: Subject to any disclaimer, the term of this patent is extended or adjusted under 35 U.S.C. 154(b) by 0 days.

(21) Appl. No.: 11/484,372

(22) Filed: Jul. 10, 2006

(65) Prior Publication Data

US 2007/0010172 A1 Jan. 11, 2007

Related U.S. Application Data

(60) Provisional application No. 60/697,893, filed on Jul. 9, 2005.

(51) Int. Cl.
*B24B 33/00* (2006.01)

(52) U.S. Cl. ..... 451/11; 451/72; 451/443

(58) Field of Classification Search ..... 451/11, 451/8, 10, 72, 443, 444, 56, 285
See application file for complete search history.

(56) References Cited

U.S. PATENT DOCUMENTS

| | | | | |
|---|---|---|---|---|
| 5,975,994 | A | 11/1999 | Sandhu et al. | |
| 6,036,583 | A | 3/2000 | Perlov et al. | |
| 6,196,896 | B1 | 3/2001 | Sommer | |
| 6,293,853 | B1 | 9/2001 | Perlov et al. | |
| 6,343,974 | B1 | 2/2002 | Fran.cedilla.a et al. | |
| 6,517,414 | B1 | 2/2003 | Tobin et al. | |
| 6,645,046 | B1 | 11/2003 | Vogtmann et al. | |
| 6,719,619 | B2 * | 4/2004 | Kuo et al. | 451/443 |
| 6,893,336 | B2 * | 5/2005 | Jin | 451/443 |
| 6,935,938 | B1 | 8/2005 | Gotkis et al. | |
| 6,949,016 | B1 | 9/2005 | de la Llera et al. | |
| 6,976,907 | B2 | 12/2005 | Golzarian et al. | |
| 2002/0055325 | A1 * | 5/2002 | Suzuki | 451/285 |
| 2003/0186627 | A1 * | 10/2003 | So | 451/56 |

OTHER PUBLICATIONS

Airpot Corporation, Norwalk CT.

* cited by examiner

*Primary Examiner*—Jacob K. Ackun, Jr.
(74) *Attorney, Agent, or Firm*—Wendy W. Koba

(57) ABSTRACT

A CMP conditioning apparatus enhanced end effector arm for improving the reliability of the apparatus and the quality of the conditioning and polishing operations includes a conditioner head with features that provide for simplified alignment/attachment of a conditioning disk to the arm, while also providing a "quick release" mechanism for maintenance operations. The enhanced arm also includes an improved actuator that provides for a static friction ("stiction")-free movement of the arm and better control of the downforce applied by the conditioning disk to the polishing pad. A dual-drive pulley system is used within the enhanced end effector arm to minimize the tilting of the drive belts within the effector arm as the arm pivots to follow the contour of an "aging" polishing pad.

12 Claims, 8 Drawing Sheets

ENHANCED END EFFECTOR ARM ARRANGEMENT FOR CMP PAD CONDITIONING

CROSS-REFERENCE TO RELATED APPLICATION

This application claims the benefit of U.S. Provisional Application No. 60/697,893, filed Jul. 9, 2005.

TECHNICAL FIELD

The present invention relates to conditioning apparatus for use in a chemical mechanical planarization (CMP) system and, more particularly, to an improved end effector arm configuration to provide well-controlled, reliable and efficient movement and operation of the end effector arm with respect to the polishing pad surface.

BACKGROUND OF THE INVENTION

In the field of chemical mechanical planarization (CMP), a process known as "pad conditioning" or "pad dressing" is used to restore the surface of the polishing pad and remove surface glazing by dislodging particulates and spent polishing slurry from the pad. Pad conditioning also re-planarizes the polishing pad by selectively removing pad material so as to roughen the newly-exposed pad surface. Pad conditioning may be performed "ex-situ" (i.e., conditioning the polishing pad between wafer polishing cycles) or "in-situ" (i.e., concurrent with, or during, a wafer polishing cycle). In a typical prior art "in-situ" pad conditioning process, a fixed abrasive conditioning disk is swept across the pad surface to remove a small amount of pad material and accumulated debris, thus creating new asperities in the pad surface to allow for the free flow of the polishing slurry. The removed pad material and debris then combine with the used polishing slurry and are passively carried away from the pad.

In most typical in-situ conditioning arrangements, the abrasive conditioning disk is held within a rotatable arm (referred to as an "end effector arm" or "conditioning arm") that sweeps the disk across a portion of the polishing pad not currently in use. One particular arrangement is described in detail in U.S. Pat. No. 7,052,371 issued to S. J. Benner on May 30, 2006, assigned to the assignee of the present application and herein incorporated by reference. FIGS. 1 and 2 illustrate an exemplary conditioning arrangement as taught by Benner, where FIG. 1 illustrates the arrangement in a top view, and FIG. 2 in a side view. As shown, a conditioning apparatus 10 (referred to hereinafter as "conditioner head 10") is mounted on a motorized end effector arm 12 so as to allow conditioner head 10 to sweep back and forth across the surface of polishing pad 14 (illustrated by arc AB in FIG. 1). An abrasive conditioning disk 22, mounted on the bottom of conditioner head 10, dislodges agglomerated debris as head 10 sweeps across polishing pad 14. End effector arm 12 is configured to impart a predetermined downward force (denoted "F" and shown in FIG. 2) and rotational movement (denoted "R" and shown in FIG. 2) to the conditioning disk, where a motor 17 is used in this particular embodiment to both pivot end effector arm 12 in arc AB (or through any other appropriate translational movement) about a fixed shaft 18, and provide rotational motion R and downward force F to the conditioning disk. This particular arrangement is considered to be exemplary only, with other systems utilizing, for example, a stationary abrasive (in place of a rotating conditioning disk), or an abrasive structure that covers the full pad radius and thus does not need to "sweep" across the pad to provide the conditioning effect.

In the above-cited Benner arrangement, apertured conditioning disk 22 is used to both dislodge surface glazing from the polishing pad and evacuate the dislodged debris through the application of a vacuum force pulling through and around the apertures formed in conditioning disk 22. As shown in FIGS. 1 and 2, a vacuum force V pulls debris upward and evacuates the debris through a channel 25 and away from polishing pad 14. Apertured conditioning disk 22 itself is attached to conditioner head 10 by either a mechanical arrangement, or by a magnetic mounting device 24 that is disposed between conditioning disk 22 and conditioner head 10. It is important to the proper operation of the conditioning process that the apertured conditioning disk be properly aligned with the other components in the conditioner head. During operation, proper alignment between the pad and the removal features also allows for efficient evacuation of the debris from the polishing pad surface. Proper alignment is also important for the resultant planarity of the polishing pad, which is a major factor in improving wafer polishing uniformity and reducing defectivity.

In high volume industrial applications, there is a constant need to improve the CMP apparatus and processes inasmuch as planarization of a semiconductor wafer is repeatedly used during the integrated circuit fabrication process, where there is significant cost and effort expended before and during each planarization operation. Any quality problems associated with the planarization can result in multiple "die" or chips being lost, with up to an entire wafer needing to be discarded, which is certainly an undesirable event. While quality issues concerning conditioning and polishing need to be addressed, the associated issues of efficiency and expense cannot be ignored, where "quality" and "expense" are often areas of concern that are in tension.

For example, in order to remove an abrasive conditioning disk from the CMP structure (i.e., to replace the disk and re-qualify the process), the conditioning disk must be unscrewed, unfastened, and/or grasped by hand and pried away (e.g., with a blade) in order to break the magnetic or mechanical force and pull the disk away from the conditioner head. At times, this manual operation may be cumbersome and may shed unwanted particulates onto the polishing pad surface. In most cases there is little clearance between the end effector arm of the conditioner and the polishing pad itself. Additionally, since any process involving removal of the conditioning disk is most often carried out in a clean room environment where the personnel must where gloves (and possibly other awkward attire) that are cumbersome/clumsy and may lead to damage or misalignment of the disk, or the remaining components. Misalignment can lead to chatter, which can cause shedding in addition to the pad non-uniformity. Slurry build-up due to misalignment can also lead to large particle (agglomerate) polishing defects. Radial variations in the polishing pad surface (a common problem resulting from different wear rates due to differences in abrasive/pad relative speed differences) are further exaggerated when the conditioning disk is misaligned with the conditioner head. The state-of-the-art processing leaves a trough, or shallow center region, on the polishing pad (due to the above-described speed differences), which creates high wafer polishing force in both of the "thicker" regions on the pad (if the trough is amplified), or laden with particles for the reasons for the reasons described above, exaggerating wafer polishing defects and results in non-uniform (edge fast) polishing.

Another problem area is associated with the translational movement of the end effector arm itself. In conventional use, end effector arm 12 translates in the z direction (i.e. "up" and "down") as it is raised and lowered during the conditioning process, where this translational movement is controlled by an actuator 20 located within the end effector arm. The diaphragm, or piston action of a conventional actuator has been found to be problematic, with the diaphragm exhibiting poor reliability. Additionally, conventional air cylinder pistons often require a force of greater than five p.s.i. to initiate the movement of the actuator (that is, to break the static force of the assembly and seal friction). Thus, in most cases, the applied downforce of the conditioning disk onto the polishing pad must overcome this initial frictional force, and thereafter provide a corrective force to bring the system to the proper setpoint. If the setpoint requires less than 5 p.s.i. to be maintained, the break-away force cannot easily be achieved. In some equipment, the lifting force is not supplied by positive pressure, but is instead supplied by a vacuum (negative force). This configuration cannot be used to reliably offset the weight of the end effector itself, or frictional components within the actuator, making low downforce (e.g., less than two pounds) conditioning impossible. The result of these prior art actuator problems can be over-conditioning/dressing of the polishing pad, as a result of the inability to consistently and repeatedly achieve low abrasive downforces. Alternatively, or additionally, such prior art systems may require increased maintenance associated with over-cycling of the actuator in a mode referred to as "partial pad conditioning". The partial pad conditioning mode provides the ability to cycle the dressing of the pad between "on" and "off" phases during a conditioning operation in an attempt to reduce the pad wear rate. This mode is intended to compensate for the lack of low downforce, contiguous conditioning. Partial pad conditioning can also lead to non-uniform dressing as the start and stop locations of the process are not precisely controlled. This leads to lesser process capability, poorer quality control of the polishing operation and potentially to process control-related down-time.

Moreover, in swept conditioner applications, as the polishing pad begins to age and presents an uneven top surface, the end effector arm will need to pivot slightly or adjust to height differences as the conditioner head sweeps back and forth. The pivoting range is desired to be, in most cases, a total of no more than 10°, with the design parameter of "level" defined for the mid-life thickness of the polishing pad. Any mechanical drive components within the end effector arm must be able to move through this range, while maintaining proper alignment/engagement. Misalignment can lead to a variety of reliability and/or particle generation (polishing defects) problems.

Thus, a need remains in the art for an improved conditioning apparatus and method for use in a CMP system that provides increased reliability and simplified serviceability to further improve the overall operation of the CMP system in terms of polishing/conditioning quality, efficiency and reliability.

SUMMARY OF THE INVENTION

The needs remaining in the prior art are addressed by the present invention, which relates to conditioning apparatus for use in a chemical mechanical planarization (CMP) system and, more particularly, to an improved end effector arm configuration to provide well-controlled and efficient movement and operation of the effector arm with respect to the polishing pad surface during conditioning processes.

In accordance with the present invention, a conditioning apparatus end effector arm is formed to include various features that operate together in a manner that simplifies the maintenance associated with the conditioning disk itself, while also improving the precision and control of the downforce applied by the conditioning disk onto the polishing pad surface. The enhanced end effector arm of the present invention provides for more consistent dressing of the polishing pad surface, which results in improving the quality and efficiency of the associated polishing operation(s) by limiting the opportunity for variations in the conditioning process to occur and upset the performance of the polishing process.

In an exemplary embodiment of the present invention, a "quick release" mechanism for removing/replacing the abrasive conditioning disk is used that eliminates the need for other tools to be brought into contact with the conditioner head, or for an individual to physically contact the disk itself. The elimination of these prior art actions is seen as thus limiting the potential for contamination of the CMP system, or for breakage to occur as maintenance operations are performed on the abrasive conditioning disk. The quick release mechanism takes the form of one or more ejector mechanism (for example, pins or plungers) that are disposed through the conditioner head and contact the conditioning disk such that by depressing the mechanism(s) the disk may be removed. Further improvement in the reliability of the conditioning disk is found by having a passive alignment arrangement, in the form of magnetic locators, disposed within the conditioning disk and the conditioner head itself, so that the disk will automatically attach to, and align with, the conditioner head upon replacement.

In one embodiment of the present invention, a pair of ejector mechanisms (which would typically be spring-loaded pins) are disposed at opposing locations on the outer periphery of the enhanced end effector arm conditioner head in a manner such that when the mechanisms are pressed downward, they contact the back surface of the abrasive conditioning disk with a force sufficient to release the magnetic or mechanical hold between the abrasive conditioning disk and the conditioner head. Advantageously, the application of a sufficient balanced force can easily be applied to the mechanisms by hand to quickly and easily remove the abrasive conditioning disk without the need for additional tools or physical handling of the conditioning disk itself.

Quality improvements associated with controlling the downforce applied through the conditioning disk to the polishing pad are achieved in accordance with the enhanced end effector arm of the present invention through the incorporation of a "static friction" (stiction)-free actuator for controlling both the vertical movement of the end effector arm and the downforce applied by the arm's conditioner head on the CMP polishing pad. In one embodiment of the present invention, a zero-stiction actuator may comprise a two-way piston including a glass housing with a graphite piston. The graphite piston rides within a very closely matched glass housing allowing for only very slight leakage around the sides, thus virtually eliminating any perceptible static friction forces therebetween. The use of a precision pneumatic regulator, which actively and predictably vents the feedback leakage pressure, provides for accurate control of the bi-directional movement of the actuator and a resulting accurate application of downforce to the conditioning head.

Quality problems associated with the tilting of the conditioner head as the polishing pad ages (resulting in a non-planar polishing pad surface) are addressed in accordance with the present invention through the use of a dual-drive/intermediate pulley arrangement within the end effector arm. The use of a pair of drive belts has been found to minimize the unwanted tilting movement of the belt drive system as the arm conforms to the uneven surface of an aging polishing pad. In particular, by using a "split" dual-drive belt, the span over which the arm must pivot is cut in half, thus reducing the tilt that the belt must follow as the polishing pad ages.

Other and further aspects and advantages of the present invention will become apparent during the course of the following discussion and by reference to the accompanying drawings.

BRIEF DESCRIPTION OF THE DRAWINGS

Referring now to the drawings.

DETAILED DESCRIPTION

In accordance with the present invention, an enhanced end effector arm for CMP systems has been developed that provides for an accurate and well-controlled conditioning process, which thus results in improving the quality and longevity of the polishing pad itself and ultimately improves the quality of the polishing/planarization processes performed by the CMP system. Inasmuch as the end effector arm is essentially the control mechanism of the conditioning operation, improvements in the various aspects of the arm's components are quickly realized in terms of increased reliability and simplified maintenance of the CMP apparatus, as well as in terms of improving the quality of the overall conditioning and polishing processes. The enhanced end effector arm of the present invention incorporates various features that function in a cooperative and cumulative manner to improve the performance and reliability of the arm itself, resulting in also improving the overall quality of the conditioning and polishing processes.

Figure 3:
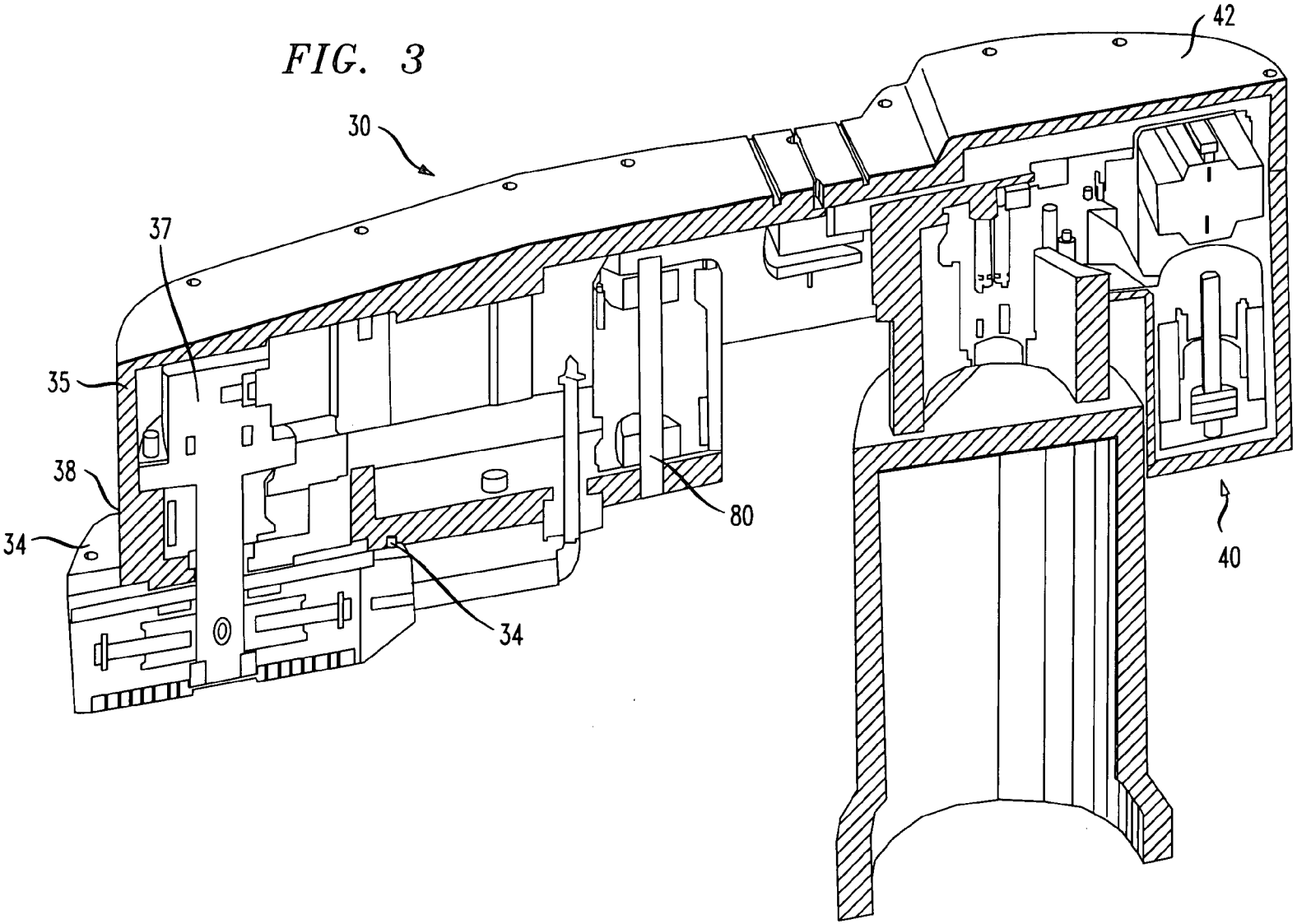
FIG. 3 is a cut-away isometric view of an enhanced effector arm formed in accordance with the present invention.

FIG. 3 illustrates, in a cut-away isometric view, an exemplary enhanced end effector arm 30 as formed in accordance with the present invention in the manner outlined above. In particular, enhanced end effector arm 30 includes an improved conditioner head 38 including features to provide simplified alignment/attachment of an abrasive conditioning disk 36 to conditioner head 38, (shown in more detail in alignment/attachment mechanism 32 in FIG. 5), as well as features to provide for simplified removal of the conditioning disk when desired (for repair, cleaning, replacement, or the like). The removal features in the inventive enhanced effector arm comprise a set of quick-release ejector mechanisms 34 (shown in detail in FIG. 6) that break the force (e.g., magnetic attraction or mechanical coupling through the use of detent break-away elements, latches, etc.) between abrasive conditioning disk 36 and conditioner head 38 without the need to use additional tools or manually pry the disk away from the conditioner head. For the sake of reference with the following figures, FIG. 3 also shows a terminating portion 35 of arm 30 to which conditioner head 38 is attached, where a rotary union 37 associated with the movement of the conditioning disk is also shown.

In accordance with the present invention, enhanced end effector arm 30 further comprises a zero-stiction actuator mechanism 40 disposed in this particular embodiment within opposing end portion 42 of enhanced end effector arm 30. Zero-stiction actuator mechanism 40 comprises a piston and cylinder arrangement that creates little, if any, static friction as the piston moves along the cylinder, and as a result provides for the ability to more accurately control the downforce applied to conditioner head 38 (for example, with a resolution capability of 50 grams or less) since there is no initial static force ("breakaway force") to overcome. As will be described in detail hereinbelow, the ability to so precisely control the applied downforce allows for a resultant "zero" downforce capability where the conditioner head may be suspended without any mechanical abrading of the polishing pad taking place. This precise control of the applied downforce also allows for variable control of the polishing pad removal rate during conditioning, most advantageously at varying radial positions across the polishing pad. Indeed, polishing pads classically wear faster in the middle, and slower at the center and edge due to rotation velocity differences. The application of higher forces at these radial positions allows for the pad removal rate to be accelerated, and as a result one can control the pad profile or topography much more precisely, and without reducing overall pad life. This capability also allows for control at zero downforce of the dispensing of chemicals or other materials, relative to the radial position. These advantages were heretofore unavailable with conventional end effector arm configurations. The operation and advantages of actuator mechanism 40 will be described in more detail below in association with FIGS. 7 and 8.

Also shown in enhanced end effector arm 30 of FIG. 3 is a dual-drive/intermediate pulley arrangement 80 that has been found to minimize the unwanted tilting movement of the associated drive belts as arm 30 pivots by "splitting" essentially in half the span across which such unwanted movement would occur. These various aspects of enhanced effector arm 30 will now be described in more detail hereinbelow.

Figure 4:
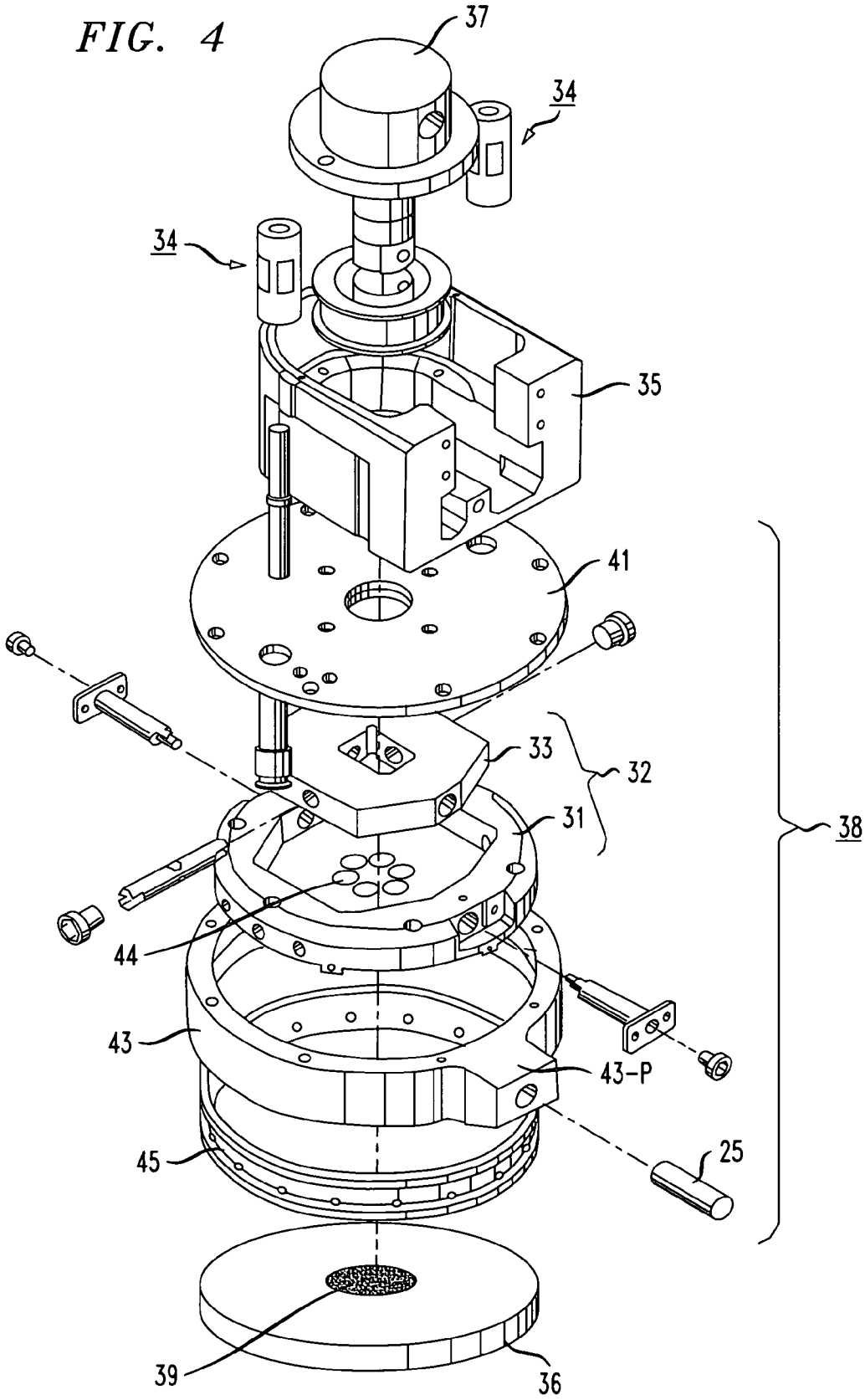
FIG. 4 is a detailed, exploded view of the conditioner head portion of the enhanced effector arm of the present invention.

FIG. 4 illustrates, in an exploded view, selected components of conditioner head 38 of inventive enhanced effector arm 30. Certain elements, not pertinent to the subject matter of this invention, are not called out or described in detail. Terminating portion 35 and rotary union 37 of effector arm 30 are also shown in this view, for the sake of understanding the relationship between the components of conditioner head 38 and effector arm 30. In accordance with the present invention, and as shown in an exploded view in FIG. 4, a pair of ejector mechanisms 34 (in this particular embodiment illustrated as a pair of pins) is disposed in conjunction with conditioner head 38 and used to break the magnetic attraction and quickly release conditioning disk 36 from conditioner head 38. Also shown in FIG. 4 is magnetic keyed alignment/attachment arrangement 32, where arrangement 32 is illustrated and explained below in association with FIG. 5. Other components of head 38 as shown in FIG. 4 include a vacuum chamber for pulling debris from the polishing pad surface, the vacuum chamber comprising a top plate 41, an outer vacuum chamber 43 and an inner vacuum chamber 45. Evident in the view of FIG. 4 is a vacuum port 43-P disposed at a predetermined exit location along outer vacuum chamber 43. As discussed above, the debris from the conditioning process is pulled away from the polishing pad surface by applying a vacuum through port 43-P and allowing the debris to be evacuated through the apertures in conditioning disk 36 and through channel 25 into a disposal system (not shown).

Figure 5:
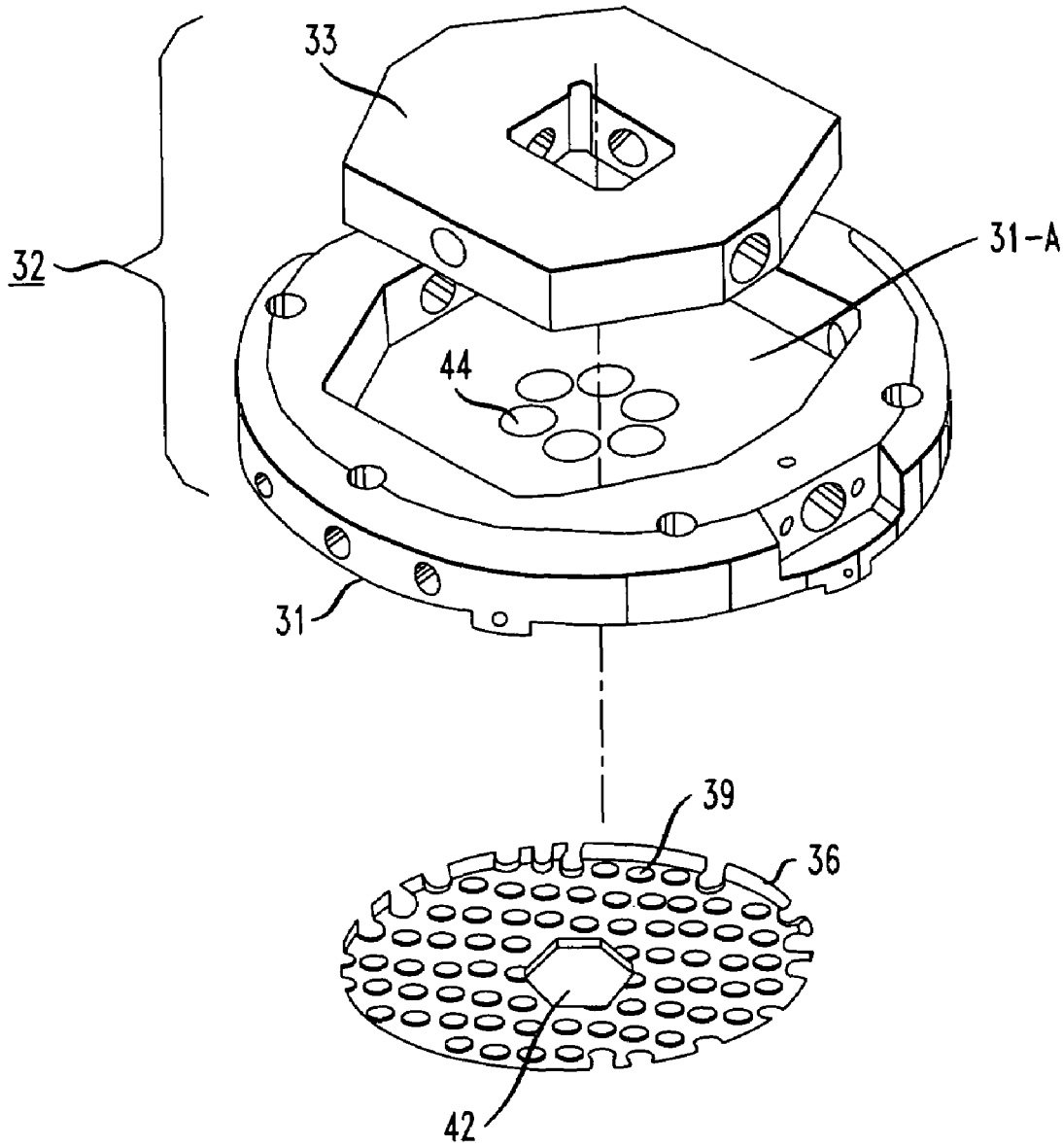
FIG. 5 is a further detailed view of the magnetic hex key configuration within the conditioner head of FIG. 4.

Referring to FIG. 5, an exemplary apertured conditioning disk 36 is shown in association with magnetic keyed alignment/attachment arrangement 32, where in this particular embodiment a hexagonally-shaped key is used to create an anti-rotational alignment arrangement. In accordance with the present invention, abrasive conditioning disk 36 is configured to include a central key aperture 42 that is filled with magnetic material 39. Attachment arrangement 32 is shown as comprising an impeller body 31 including a central aperture 31-A and a yoke 33 that fits within aperture 31-A. In prior art arrangements, a separate magnetic disk piecepart (or another mechanical component) was required to attach the conditioning disk to the conditioner head, adding to the expense and complexity of the conditioning apparatus. In accordance with the present invention, the need for this separate component has been eliminated and the attachment/alignment process has been significantly simplified by utilizing a plurality of magnetic elements 44 disposed within central aperture 31-A of impeller body 31. These magnetic elements 44 are disposed so as to align with magnetic material 39 within key aperture 42 of conditioning disk 36 and thus provide the desired attachment and alignment between abrasive conditioning disk 36 and conditioner head 38. As a result, a conditioning disk may be easily and repeatedly attached to and aligned with the conditioner head in a relatively simple manner (each alignment possibly within 60° (hexagonal), typical drive mechanics at 180° (drive pins)) that improves the overall efficiency and quality of the CMP conditioning process. It is to be noted that the hexagonal shape of exemplary yoke 33 and aperture 31-A are considered as exemplary only, and various other geometries that provide the desired type of anti-rotational/alignment and drive force capabilities between rotary union 37 (of FIG. 4), yoke 33 and disk 36 may be used in its place. As will become apparent during the course of the following discussion, the utilization of alignment/attachment arrangement 32, in conjunction with the "back-side"/quick-release mounting of abrasive conditioning disk 36 onto conditioner head 38, provides a system that will efficiently transfer drive torque from the arm to the disk, while containing any generated particles and preventing the particles from contaminating the polishing pad.

Figure 1:
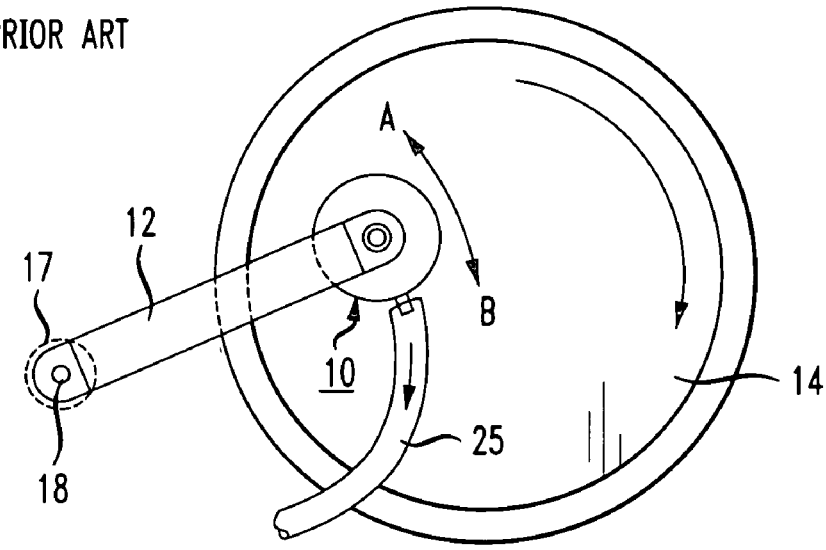
FIG. 1 PRIOR ART
FIG. 1 is a top view perspective of a prior art conditioning apparatus.
Figure 2:
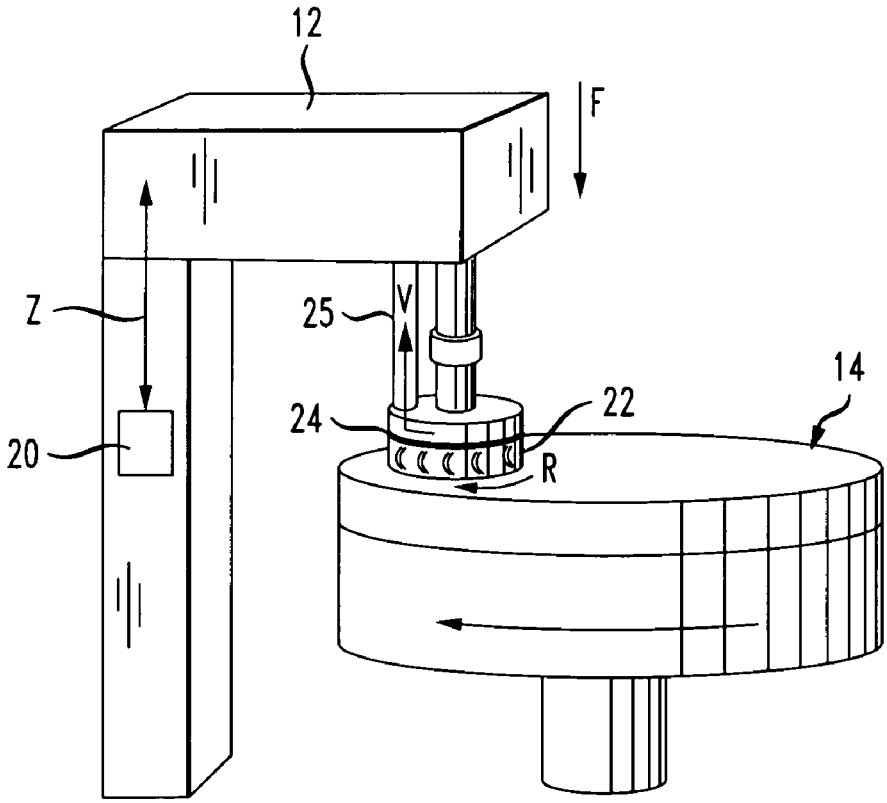
FIG. 2 PRIOR ART
FIG. 2 is a side view of the prior art arrangement of FIG. 1.
Figure 6:
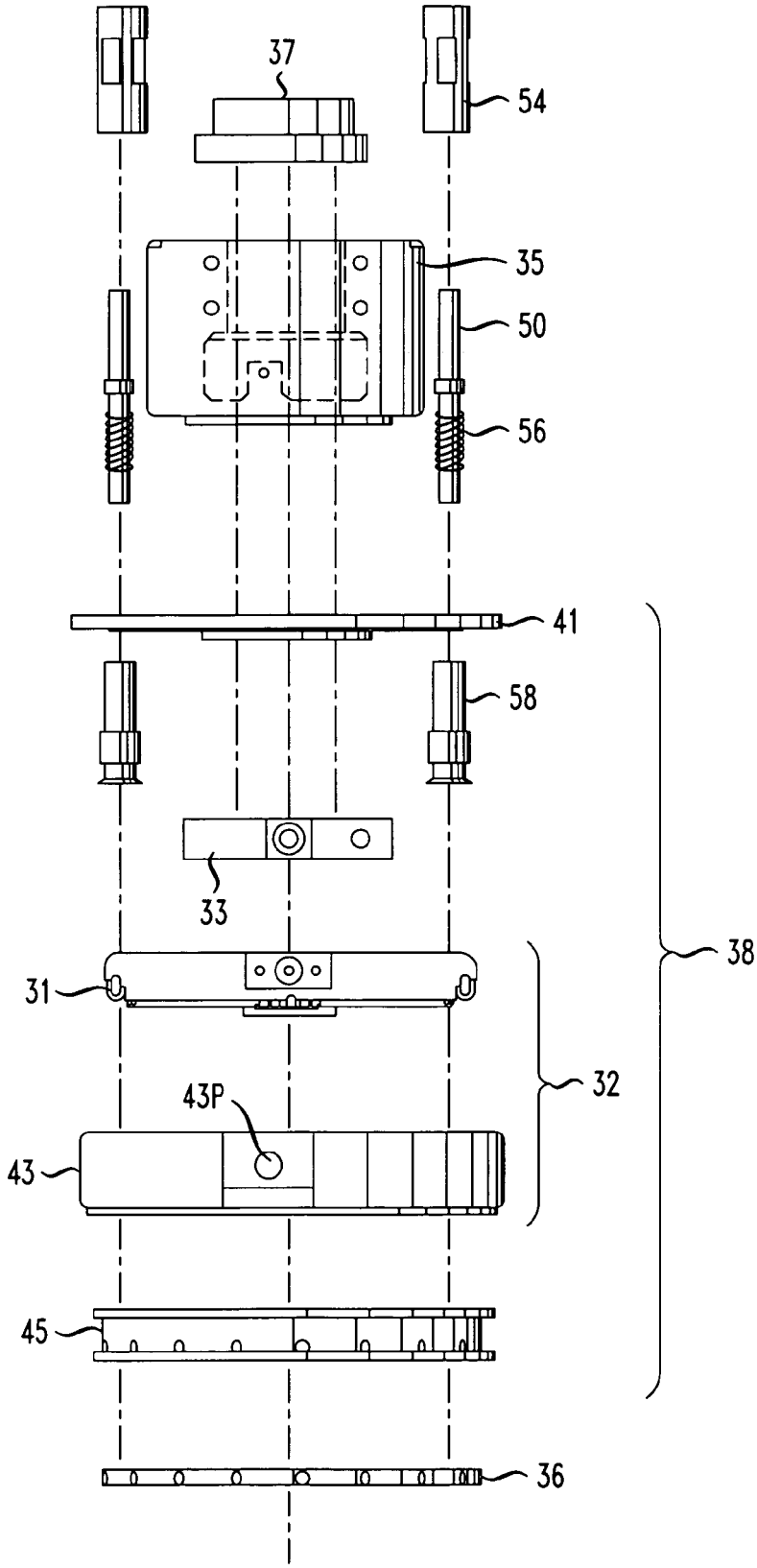
FIG. 6 is a further detailed view of the conditioning disk quick-release mechanism within the conditioner head of FIG. 4.

FIG. 6 illustrates, in an exploded view, the details of inventive quick-release ejector mechanisms 34 of enhanced effector arm 30 that are used to efficiently disengage conditioning disk 36 from head 38. As mentioned above, prior art effector arm configurations required that the abrasive conditioning disk be removed by manually grasping the disk and prying with a blade to break the magnetic or mechanical force between abrasive conditioning disk 36 and the conditioner head. This became a cumbersome task, since in most cases there is little clearance between the end effector arm of the conditioning apparatus and the polishing pad itself (see FIG. 2). Moreover, the removal process is generally carried out in a clean room environment where the personnel must wear gloves and other awkward attire, increasing the potential for damage to the disk or the remaining components as the disk is pried away from the conditioner head. These conventional manual removal processes also provide an opportunity for contaminants to enter the environment, for the tool to be damaged, provide a source of particulate contaminants, associated with the breaking off of slurry, for example, and/or undesired gouging of CMP apparatus piece-parts. These particulates can further lead to wafer scratches and/or problems in re-qualifying the CMP apparatus for further processing.

In accordance with the present invention, a "quick release" arrangement has been developed that utilizes a pair of ejector mechanisms 34 that effectuate the movement of a pair of pin elements 50 downward through conditioner head 38 and against the back surface of conditioning disk 36. While the particular embodiment of FIG. 6 illustrates the use of "pins" as the ejection mechanism, it is to be understood that any suitable mechanical "de-latching" arrangement may be used. For the sake of simplicity, the remaining discussion will sue the term "ejector pin", where it is to be understood that the broader definition of "mechanism" applies as well. Referring to FIG. 6, an exemplary embodiment of an ejector pin 34 is shown as including an upper housing element 54, sized to allow for simple movement of the pin elements themselves. In this particular embodiment, pin element 50 is spring-loaded within upper housing 54, as evident by a spring 56, so that pin element 50 returns to its initial position. The use of such spring-loading, however, is considered optional and other means of encasing and translating pin element 50 may be used and are considered to fall within the scope of the present invention. A lower housing 58 is shown in FIG. 6 to complete the encasing of pin element 50 while allowing for pin element 50 to exit through conditioner head 38 and contact the back surface of conditioning disk 36, breaking the hold between magnetic elements 39 of conditioning disk 36 and magnetic elements 44 of impeller body 31. Once conditioning disk 36 has been cleaned, replaced or repaired, re-attachment is simply provided by bringing disk 36 into the proximity of impeller body 31, where magnetic elements 44 of impeller body 31 will attract conditioning disk 36 and automatically align disk 36 to conditioner head 38 by virtue of the keyed structure. While the particular embodiment illustrated in FIG. 6 utilizes a magnetic system to hold conditioning disk 36 in place, it is to be understood that there are various mechanical arrangements that also may be used, such as various types of screws, detents and latching mechanisms. Ejector pins 34 of the present invention may similarly be used to depress these mechanical mechanisms so as to effect a release of the abrasive conditioning disk from the conditioner head.

As shown by reviewing both FIG. 4 and FIG. 6, ejector pins 34 are located so as to "clear" magnetic key alignment/attachment arrangement 32 and allow for pin elements 50 to freely move within conditioner head 38. In a preferred embodiment, a pair of ejector pins 34 is used, the pins disposed on opposite sides of conditioner head 38 as shown in FIG. 6 to allow for a balanced ejection force to be applied against conditioning disk 36.

Another quality improvement aspect of enhanced end effector arm 30, as mentioned above, is the utilization of a zero-stiction actuator to control the "up" and "down" movement of head 38, thus controlling both the downforce F applied by conditioning disk 36 against the polishing pad surface and the rotational speed of the conditioning disk itself. In the past, the piston action of a conventional actuator was problematic, often requiring a force of greater than five p.s.i. to initiate the movement of the actuator (referred to as the "breakaway force") as a result of the inherent static friction between the piston and the housing. Thus, in most cases, the applied downforce of the conditioning disk to the polishing pad had to overcome this initial frictional force, and provide a corrective force to achieve the proper operating setpoint. Therefore, in situations where the setpoint required less than five p.s.i. to be maintained, it was often impossible to achieve the necessary breakaway force. Additionally, some conventional prior art end effector arm actuators are lifted by the application of a vacuum, which cannot be used reliably to offset the weight of the mechanical components, making relatively low downforce (e.g., less than two pounds) conditioning virtually impossible.

Figure 7:
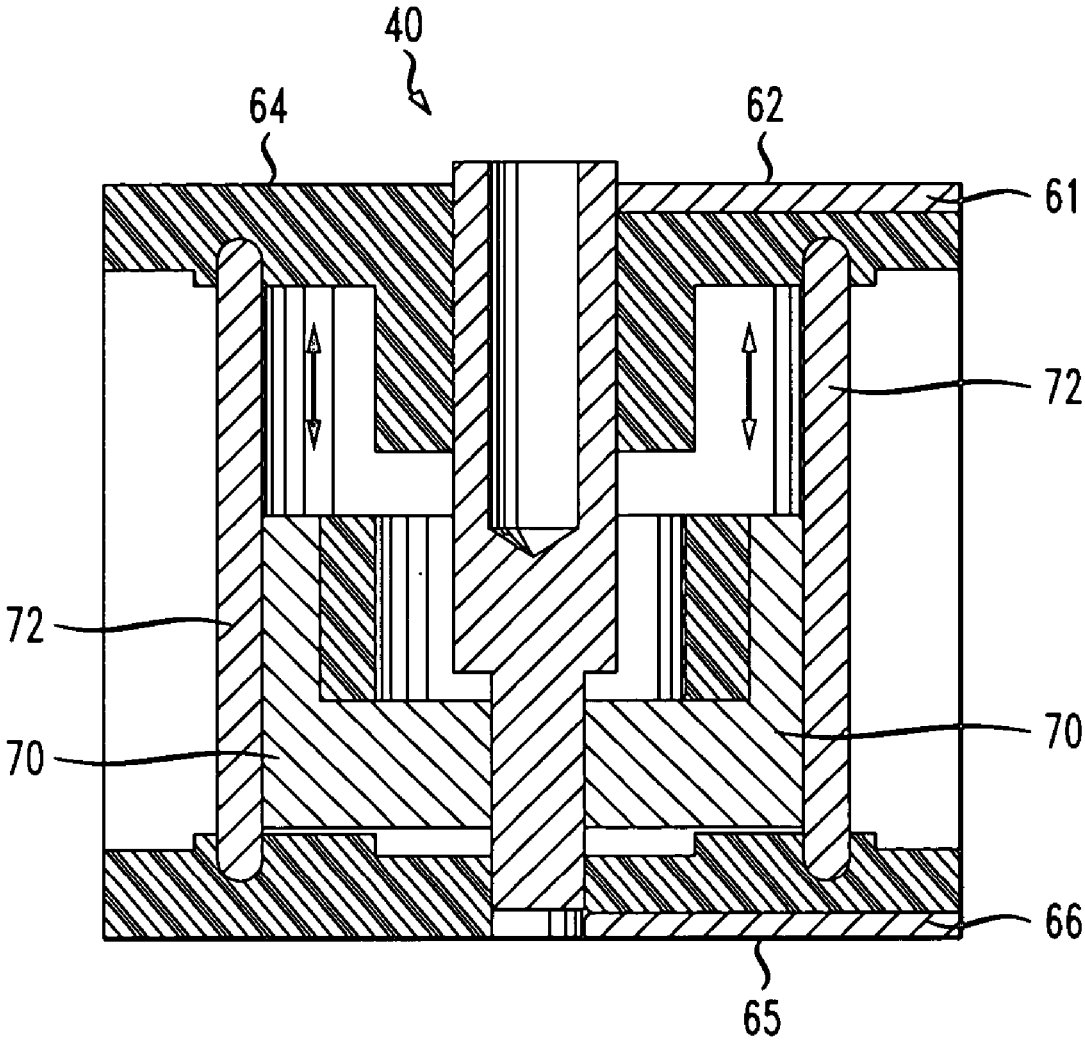
FIG. 7 is a cut-away side view of a zero-stiction actuator as used in the enhanced effector arm of FIG. 3.
Figure 8:
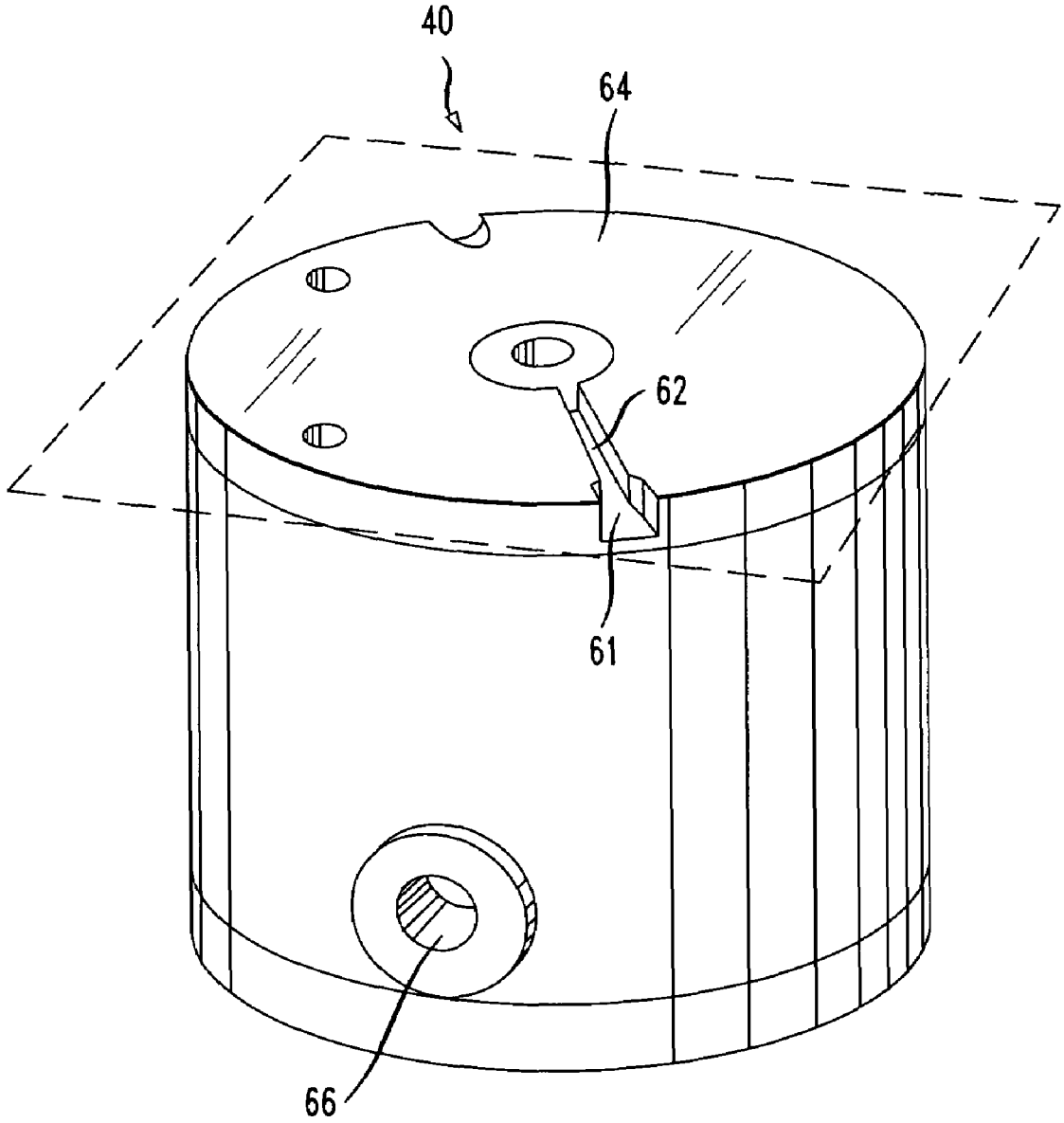
FIG. 8 is an enclosed, isometric view of the actuator of FIG. 7.

In accordance with the present invention, these actuator-associated problems have been overcome by the incorporation of "zero stiction" actuator 40 in the enhanced effector arm (where the term "stiction" is used to define the case of "static friction"). FIG. 7 illustrates a cut-away view of an exemplary zero-stiction actuator 40 of the present invention, with FIG. 8 illustrating an encased isometric view of actuator 40. Evident in both FIGS. 7 and 8 is an upper evacuation channel 62 and port 61 formed in a top surface 64 of actuator 40. A lower evacuation channel 65 and port 66 is formed in the bottom portion of actuator 40, as shown in FIG. 7. These channels allow for controlled leakage pressure to be exhausted.

It has been found that specific material choices for the piston and housing of the actuator can significantly reduce, if not eliminate, the static frictional forces that may initially bind the piston in place. In one particular embodiment of the present invention, actuator 40 comprises a graphite composite piston 70 that has a diameter closely matched to a glass (for example, a borosilicate glass (such as a Pyrex®-brand glass) or an aluminosilicate glass) cylinder 72, within which piston 70 rides, as manufactured by Airpot Corporation. The combination of the graphite piston and glass housing has been found to substantially reduce the initial "static force" that binds a conventional pneumatic actuator piston in place and which requires a substantial initial force to induce movement. In fact, the zero-stiction actuator arrangement of the present invention has been found to be able to smoothly move a weight of as little as 50 grams upward and downward without the need for an initial "impulse" force. Other combinations of materials that generate little or no static friction may also be used in the zero-stiction actuator of the present invention.

Referring again to FIGS. 7 and 8, as piston 70 is pressure-controlled to move up and down within cylinder 72, the displaced air (or gas) is evacuated and directed through upper channel 62 (or lower channel 65, as the case may be). That is, as piston 70 moves upward, the air is forced through upper channel 62 and exits at port 61 into the evacuation system of the effector arm. As piston 70 moves downward, the air will be forced into lower channel 65 and then through port 66 into the same evacuation system. In a preferred embodiment of the present invention, pneumatic regulators are disposed on each side of actuator mechanism 40 to provide balanced control of piston 70 in either direction. The evacuation path then proceeds along enhanced effector arm 30 and away from the conditioning process, so as to prevent any of the air along this path from contaminating, or coming in contact with, the various gases and slurries used in the polishing and conditioning processes themselves.

The combination of zero-stiction actuator 40 with the capability of performing precise in-line force measurements (in terms of both tension and compression) allows for the enhanced end effector arm of the present invention to operate with extremely well-controlled downforces, ranging from "zero" downforce to over forty pounds of downforce. Indeed, the mechanical dead weight of the end effector itself, coupled with the additive force associated with the presence of a vacuum and the abrasive conditioning process can be compensated for by the ability to precisely control the movement of the actuator and the downforce applied to the conditioner head. Combining this precise conditioner head control with the vacuum cleaning capabilities as disclosed in our co-pending applications allows for the inventive conditioner to remain in proximity to the pad surface while suspending the mechanical abrading action (i.e., the sum of all of the existing forces being a resultant "zero" downforce being applied to the conditioning disk). The vacuum aperture area is therefore able to remain stable and the associated flow characteristics of the various evacuated process wastes to remain equivalent, whether or not the mechanical abrading action is being used. The ability to so precisely and accurately control and adjust the downforce on the conditioning disk with the incorporation of the zero-stiction actuator allows for independent control of the vacuum and mechanical aspects of the conditioning process, resulting in a more effective and efficient conditioning process.

While the use of a zero-stiction actuator has been found to improve the force control issues (both vacuum and applied force), problems remain within the end effector arm as the polishing pad begins to age and its surface becomes non-planar. As a pad wears, its cross-section takes on a "bathtub" shape, with thicker regions in the center and edge of the diameter. These regions are problematic in that they result in higher forces being transferred to the wafer surface in the thicker 'zone'. These higher pressures lead to faster localized removal, and higher frequency of scratch, chatter-type defects at the outer regions of the wafer, corresponding to the center and edge zones of the pad. Correspondingly, the end effector arm will need to slightly pivot (or vertically follow) as the polishing pad begins to age and present an uneven top surface. This can affect the applied force, and complicate the force control described earlier (stiction response). In the pivoting implementation, the pivoting range is desired to be, in most cases, a total of no more than 10°, with the design parameter of "level" defined for the mid-life thickness of the polishing pad. The novel two pulley (dual-drive) system 80 within enhanced end effector arm 30 of the present invention has been found to improve the reliability of the rotation mechanism by transferring the rotational motion from the drive motors/gearbox so as to minimize the deflection required by the drive belt.

Figure 9:
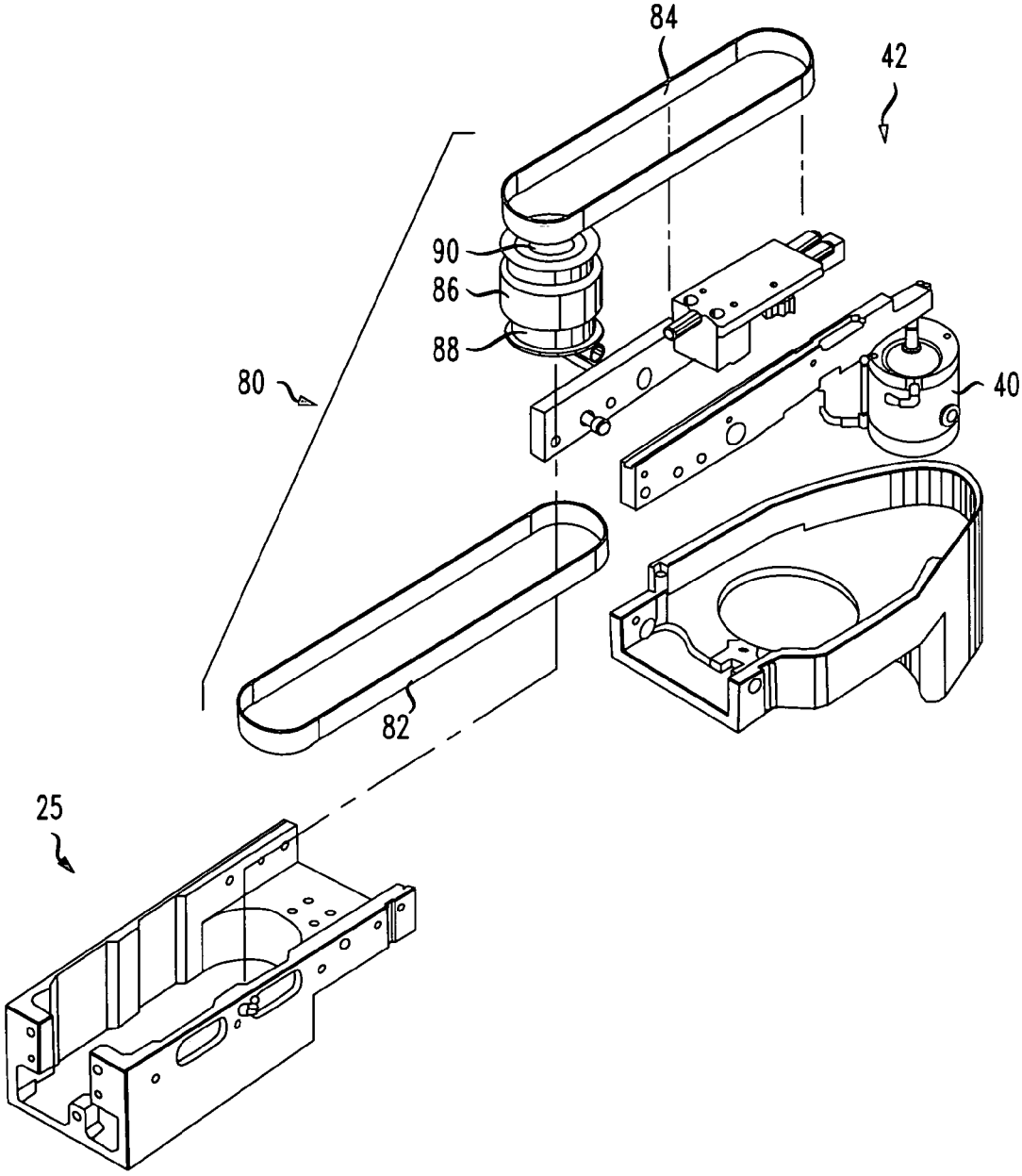
FIG. 9 is a partial, exploded isometric view of a split-drive pulley mechanism within the enhanced effector arm of FIG. 3 as used to control the "tilt" of the conditioner head.

FIG. 9 illustrates, in an exploded view, the components of an exemplary dual-drive arrangement 80 of enhanced effector arm 30. This particular view illustrates both terminal location 25 of arm 30 (associated with conditioner head 38), as well as the fixed end portion 42 including actuator 40. Dual drive arrangement 80 is shown as comprising a first drive belt 82 and a second drive belt 84, both belts 82 and 84 engaged with a pulley 86. First drive belt 82 extends outward toward conditioner head 38 and, as shown, second drive belt 84 extends inward to engage with actuator 40 and initiate the desired rotational movement for the conditioning disk (not shown). In this particular embodiment of the present invention, first drive belt 82 contacts a lower portion 88 of pulley 86, with second drive belt 84 engaging an upper portion 90 of pulley 86.

As shown in FIG. 9, pulley 86 is located just beyond the up/down pivot point of arm 30, so that its movement during pivoting is minimized. In accordance with the present invention, the "level" position is preferably set at mid-life (a typical polishing pad having a "life" in the range of 0.03" to 0.05"), since most of the deflection is experienced when the arm is lifted and the drive is not loaded. The outer portion of the inventive dual drive arrangement, comprising first drive belt 82, is thus essentially "fixed" and remains in alignment regardless of the age of the polishing pad.

The present invention has been described in detail with particular reference to preferred embodiments thereof. However, it is to be understood that variations and modifications can be effected within the spirit and scope of the present invention as defined by claims appended hereto.

What is claimed is:

1. In a CMP conditioning system, an end effector arm for controlling the application of an abrasive conditioning disk to a polishing pad surface, the end effector arm comprising:

a conditioner head disposed at a first, free end of the effector arm, the conditioner head including a keyed alignment/attachment element disposed to contact an associated abrasive conditioning disk, the keyed alignment element comprising an impeller body having a central recessed portion of a known keying geometry and including at least one coupling component for engaging the abrasive conditioning disk in an aligned attachment;

at least one ejector mechanism disposed at the periphery of the conditioner head and configured to impart a downward force onto an associated conditioning disk sufficient to break the engagement provided by the keyed alignment/attachment element when needed to remove the conditioning disk from the conditioner head; and an actuator mechanism disposed at a second, fixed end of the end effector arm for controlling the translational movement and applied downforce of the conditioner head with respect to a polishing pad.

2. A CMP conditioning system as defined in claim 1 wherein the arm is used in conjunction with an abrasive conditioning disk including magnetic material disposed within a central region thereof, the keyed alignment/attachment element coupling component comprising a magnetic component disposed within the central recessed portion so as to align with and attach to the abrasive conditioning disk magnetic material.

3. A CMP conditioning system as defined in claim 1 wherein the keyed alignment/attachment element further comprises a universal yoke of the known keying geometry of the impeller body aperture, the universal yoke for mating with the impeller body in a fixed, anti-rotational/aligned manner so as to maintain alignment between the conditioner head and an associated conditioning disk while also imparting drive force to said associated conditioning disk.

4. A CMP conditioning system as defined in claim 3 wherein the known keying geometry comprises a hexagonal keying geometry.

5. A CMP conditioning system as defined in claim 1 wherein the at least one ejector mechanism comprises an ejector pin.

6. A CMP conditioning system as defined in claim 5 wherein the at least one ejector pin comprises a spring-loaded ejector pin.

7. A CMP conditioning system as defined in claim 1 wherein the at least one ejector mechanism comprises a plurality of ejector mechanisms equally disposed around the periphery of said conditioner head.

8. A CMP conditioning system as defined in claim 7 wherein the plurality of ejector mechanisms comprises a pair of ejector mechanisms disposed in opposition on the periphery of the conditioner head.

9. A CMP conditioning system as defined in claim 1 wherein the actuator mechanism comprises a piston and a cylinder for housing the piston, the piston and the cylinder comprising materials that generate minimal static friction as the piston is moved within the cylinder.

10. A CMP conditioning system as defined in claim 9 wherein the actuator mechanism further comprises a pair of pneumatic regulators disposed on opposing terminations of the cylinder to provide for bi-directional control of the piston.

11. A CMP conditioning system as defined in claim 1 wherein the actuator mechanism comprises:

a graphite piston;

a glass cylinder encasing the graphite piston;

a first evacuation channel disposed along a top surface thereof; and a second evacuation channel disposed along an opposing bottom surface, wherein as vacuum is applied the graphite piston rides within the glass cylinder and air is evacuated along at least one of the first evacuation channel and the second evacuation channel into the end effector arm.

12. A CMP conditioning system as defined in claim 1 wherein the end effector arm further comprises:

a dual drive belt movement arrangement disposed between the conditioner head and the actuator mechanism for translating the actuator mechanism movement into movement of the conditioner head, the dual drive belt movement arrangement comprising a first drive belt coupled at a first end to the conditioner head;

a pulley disposed within the end effector arm and coupled to a second, opposing end of the first drive belt;

a second drive belt coupled at a first end to the actuator mechanism and at a second, opposing end to the pulley, wherein movement of the actuator passes through the second drive belt and is thereafter coupled by the pulley into the first drive belt, thereby resulting in movement of the conditioner head, the pulley being located along the end effector arm at a position that minimizes movement of the pulley during pivoting of the end effector arm.

* * * * *